US008499831B2

(12) United States Patent
Church

(10) Patent No.: US 8,499,831 B2
(45) Date of Patent: Aug. 6, 2013

(54) MUD CAKE PROBE EXTENSION APPARATUS AND METHOD

(75) Inventor: Nathan Church, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 194 days.

(21) Appl. No.: 12/689,593

(22) Filed: Jan. 19, 2010

(65) Prior Publication Data

US 2010/0186951 A1 Jul. 29, 2010

Related U.S. Application Data

(60) Provisional application No. 61/146,720, filed on Jan. 23, 2009.

(51) Int. Cl.
*E21B 47/00* (2006.01)
*E21B 49/10* (2006.01)
*E21B 49/08* (2006.01)

(52) U.S. Cl.
CPC ..... *E21B 49/10* (2013.01); *E21B 49/081* (2013.01)
USPC ..... 166/264; 166/174; 166/100

(58) Field of Classification Search
USPC ..... 166/264, 174, 250.01, 100; 73/152.04, 73/152.24, 152.23
See application file for complete search history.

(56) References Cited

U.S. PATENT DOCUMENTS

| | | | | |
|---|---|---|---|---|
| 3,653,436 | A | 4/1972 | Anderson et al. | |
| 3,859,851 | A * | 1/1975 | Urbanosky | 73/152.24 |
| 3,934,468 | A | 1/1976 | Brieger | |
| 4,860,581 | A | 8/1989 | Zimmerman et al. | |
| 4,951,749 | A * | 8/1990 | Carroll | 166/264 |
| 5,692,565 | A | 12/1997 | MacDougall et al. | |
| 6,164,126 | A * | 12/2000 | Ciglenec et al. | 73/152.01 |
| 7,428,925 | B2 | 9/2008 | Brown et al. | |

* cited by examiner

*Primary Examiner* — Cathleen Hutchins
(74) *Attorney, Agent, or Firm* — Cathy Hewitt; John Vereb

(57) ABSTRACT

In a formation pressure tester tool, an elongated filter piston possibly having a tapered or sharp edge configured to penetrate mud cake while the probe is being set. At the end of the setting sequence, the filter piston is retracted, thus opening a flowpath from the formation, through the mudcake, to the probe.

20 Claims, 7 Drawing Sheets

MUD CAKE PROBE EXTENSION APPARATUS AND METHOD

CROSS-REFERENCE TO RELATED APPLICATIONS

The present application claims the benefit of U.S. Provisional Patent Application No. 61/146,720, filed Jan. 23, 2009, entitled "MUD CAKE PROBE EXTENSION," the entirety of which is hereby incorporated herein by reference.

BACKGROUND OF THE DISCLOSURE

Wellbores are drilled to locate and produce hydrocarbons. A downhole drilling tool with a bit at an end thereof is advanced into the ground to form a wellbore. As the drilling tool is advanced, a drilling mud is pumped from a surface mud pit, through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. In other cases, the drilling tool may be used to perform the testing or sampling. These samples or tests may be used, for example, to locate valuable hydrocarbons.

Formation evaluation often requires that fluid from the formation be drawn into the downhole tool for testing and/or sampling. Various fluid communication devices, such as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall.

The mudcake lining the wellbore is often useful in assisting the probe in making the seal with the wellbore wall. Once the seal is made, fluid from the formation is drawn into the downhole tool through an inlet by lowering the pressure in the downhole tool. Some formations, however, tend to have very thick mud cakes. In such environments, existing probes do not penetrate the mudcake. That is, either the mudcake is too thick or it is of such a consistency that the probe does not pass through it. This prevents the acquisition of pressure data.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
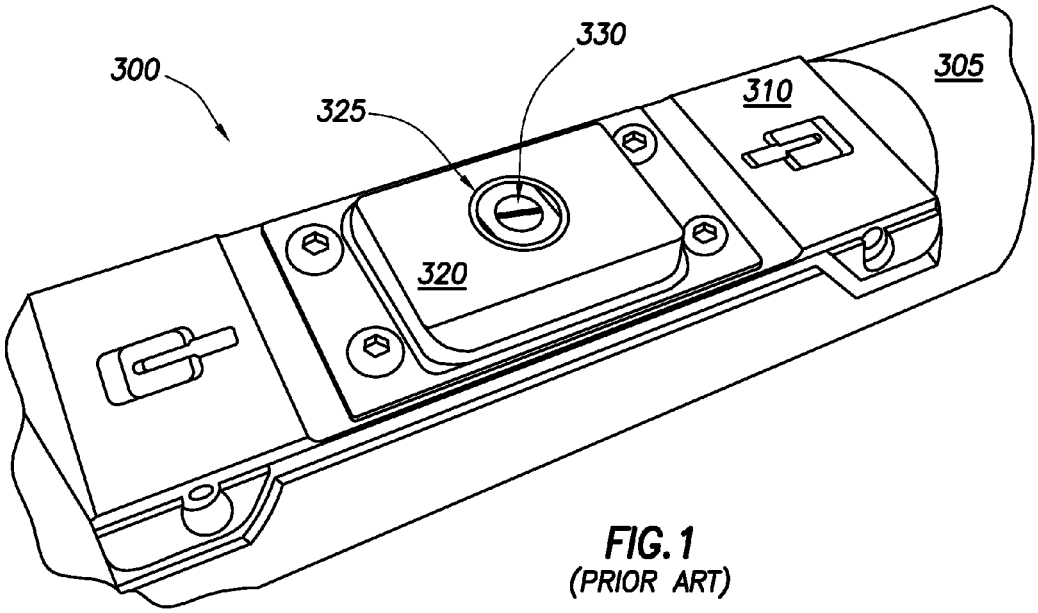
FIG. 1 (PRIOR ART)
FIG. 1 is a perspective view of apparatus according to the prior art.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure relate to those within the scope of U.S. Pat. No. 7,428,925, U.S. Pat. No. 5,692,565, and/or U.S. Pat. No. 4,860,581, which are each hereby incorporated by reference in their entirety.

FIG. 1 is a perspective view of a known formation pressure tester 300. The tester 300 includes an elongated body 305 and a probe assembly 310 configured to measure pore pressure of the surrounding formation when positioned in engagement with the wellbore wall. The probe assembly 310 is extendable from the body 305 (e.g., using hydraulic, mechanical, electrical, electromechanical, and/or other control) for sealing engagement with a mudcake and/or the wall of the borehole for taking measurements of the surrounding formation. Circuitry (not shown in this view) couples pressure-representative signals to a processor/controller, an output of which may be coupled or coupleable to telemetry circuitry.

The probe assembly 310 includes a packer 320, an inlet 325, and a filter piston 330. The packer 320 comprises an elastomeric material surrounding the inlet 325. The filter piston 330 is actuatable between an extended position (shown in FIG. 1) and a retracted position (not shown). When in the retracted position, the filter piston 330 exposes the inlet 325 to the mudcake and/or borehole wall to which the probe assembly 310 has been extended for engagement. The inlet 325 comprises a cylindrical annulus comprising a plurality of filter openings through which formation fluid may pass while filtering particulate. Thereafter, the filter piston 330 may be returned to its extended position, which may also serve to expel any filtered particulate from the inlet 325 into the borehole.

Figure 2:
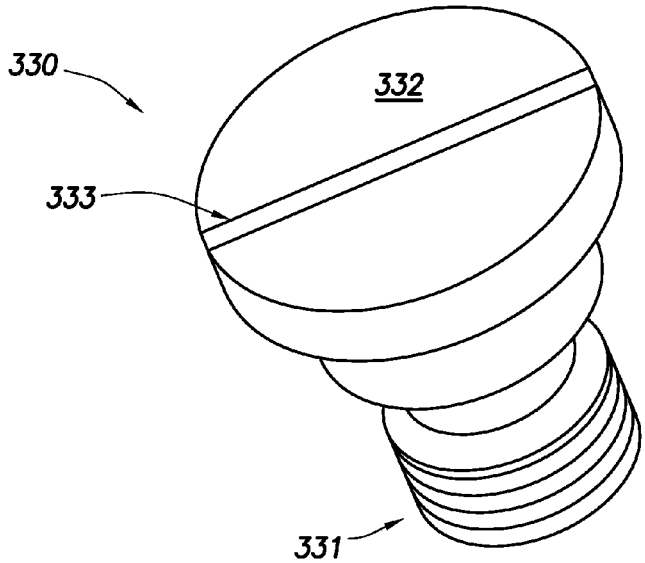
FIG. 2 (PRIOR ART)
FIG. 2 is a perspective view of a portion of the apparatus shown in FIG. 1.

FIG. 2 is a perspective view of the filter piston 330 shown in FIG. 1. The filter piston 330 includes a threaded end 331 and an external end 332. Referring to FIGS. 1 and 2, collectively, the threaded end 331 is configured to engage with an internal actuator (not shown) that is configured to translate the filter piston 330 between its extended and retracted positions. The external end 332 is configured to substantially close the inlet 325 shown in FIG. 1 when the filter piston 330 is in the extended position, and to expel any filtered particulate from the inlet 325 when translating from the retracted position to the extended position. The external end 332 may also have a slot 333 or other means for engagement with a tool utilized to assemble the filter piston 330 to the probe assembly 310.

As best shown in FIG. 1, the external end 332 of the filter piston 330 is substantially flush with the outer end of the inlet 325 when the filter piston 330 is in its extended position. Consequently, when the probe assembly 310 is engaged with the borehole wall, the filter piston 330 travels no further into the mudcake and/or formation than the inlet 325. As described above, this can be disadvantageous, particularly in environments in which the mudcake is especially thick or dense.

Figure 3:
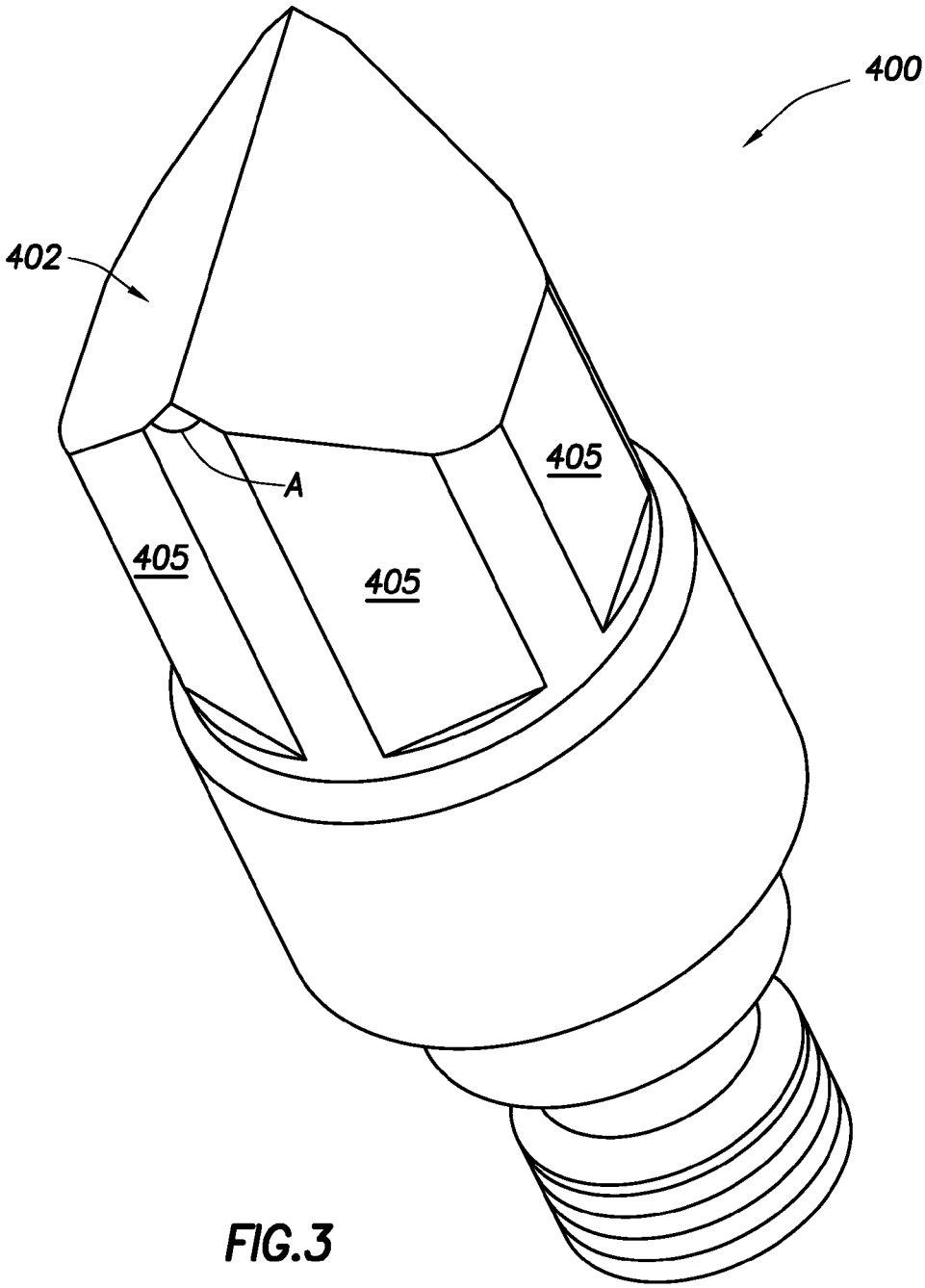
FIG. 3 is a perspective view of at least a portion of an apparatus according to one or more aspects of the present disclosure.

FIG. 3 is a perspective view of a filter piston 400 according to one or more aspects of the present disclosure. The filter piston 400 is similar to the filter piston 330 shown in FIGS. 1 and 2, with the exception that the filter piston 400 is elongated such that it protrudes from the probe assembly inlet when the filter piston 400 is in its extended position. Moreover, the external end 402 of the filter piston 400 may have a tapered profile, as shown in FIG. 3.

The taper angle A may be about 90°, as in the embodiment shown in FIG. 3. However, in other embodiments within the scope of the present disclosure, the taper angle A may range between about 70° and about 100°. Other embodiments within the scope of the present disclosure may exhibit a taper angle A ranging between about 30° and about 120°. That is, the particular taper angle A utilized is not limited within the scope of the present disclosure. The angled tip of the external end 402 may be tapered to a point, as shown in FIG. 3, or may be more rounded or blunt.

As also shown in FIG. 3, the external end 402 of the filter piston 400 may include one or more flats 405 or other means for engagement with a tool utilized to assemble the filter piston 400 to the probe assembly.

Figure 4:
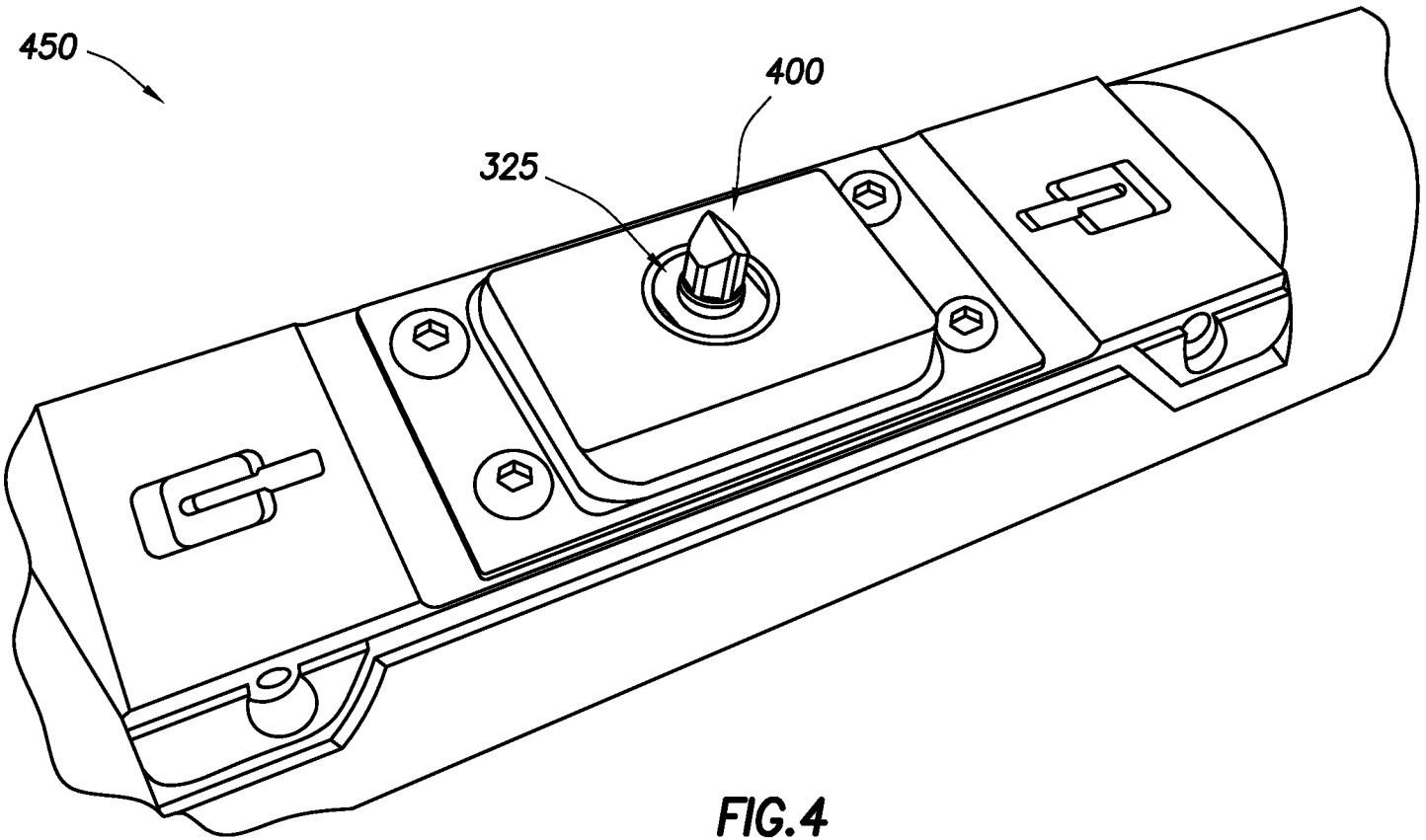
FIG. 4 is a perspective view of at least a portion of an apparatus according to one or more aspects of the present disclosure.

FIG. 4 is a perspective view of a formation pressure tester 450 according to one or more aspects of the present disclosure. The formation pressure tester 450 is substantially the same as the formation pressure tester 300 shown in FIG. 1, with the exception that the formation pressure tester 450 includes the filter piston 400 shown in FIG. 3 instead of the filter piston 330 shown in FIGS. 1 and 2. Consequently, because the elongated filter piston 450 is substantially longer than the filter piston 330, the filter piston 450 protrudes beyond the end of the inlet 325 when in the extended position.

That is, in past embodiments, the filter piston (e.g., 330) has a flat surface that makes contact with the formation. However, according to one or more aspects of the present disclosure, the filter piston 400 is elongated and may have a sharp or tapered edge at its external end 402. The external end 402 may be configured to penetrate the mud cake while the probe is being set. At the end of the setting sequence, the filter piston 400 is retracted, thus opening a flowpath from the formation through the mudcake and to the probe.

Figure 5:
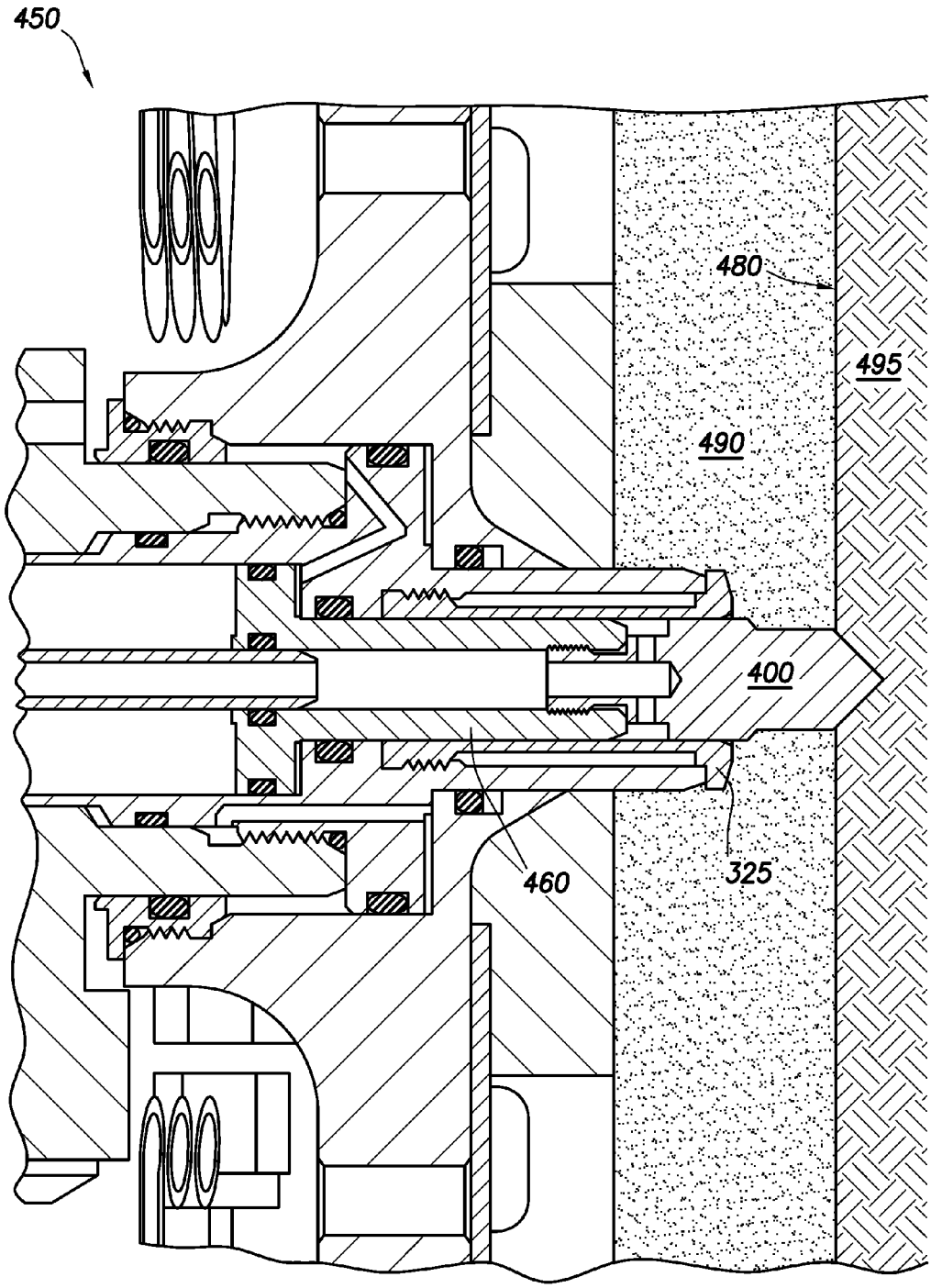
FIGS. 5 and 6 are sectional views of the apparatus shown in FIG. 4.
Figure 6:
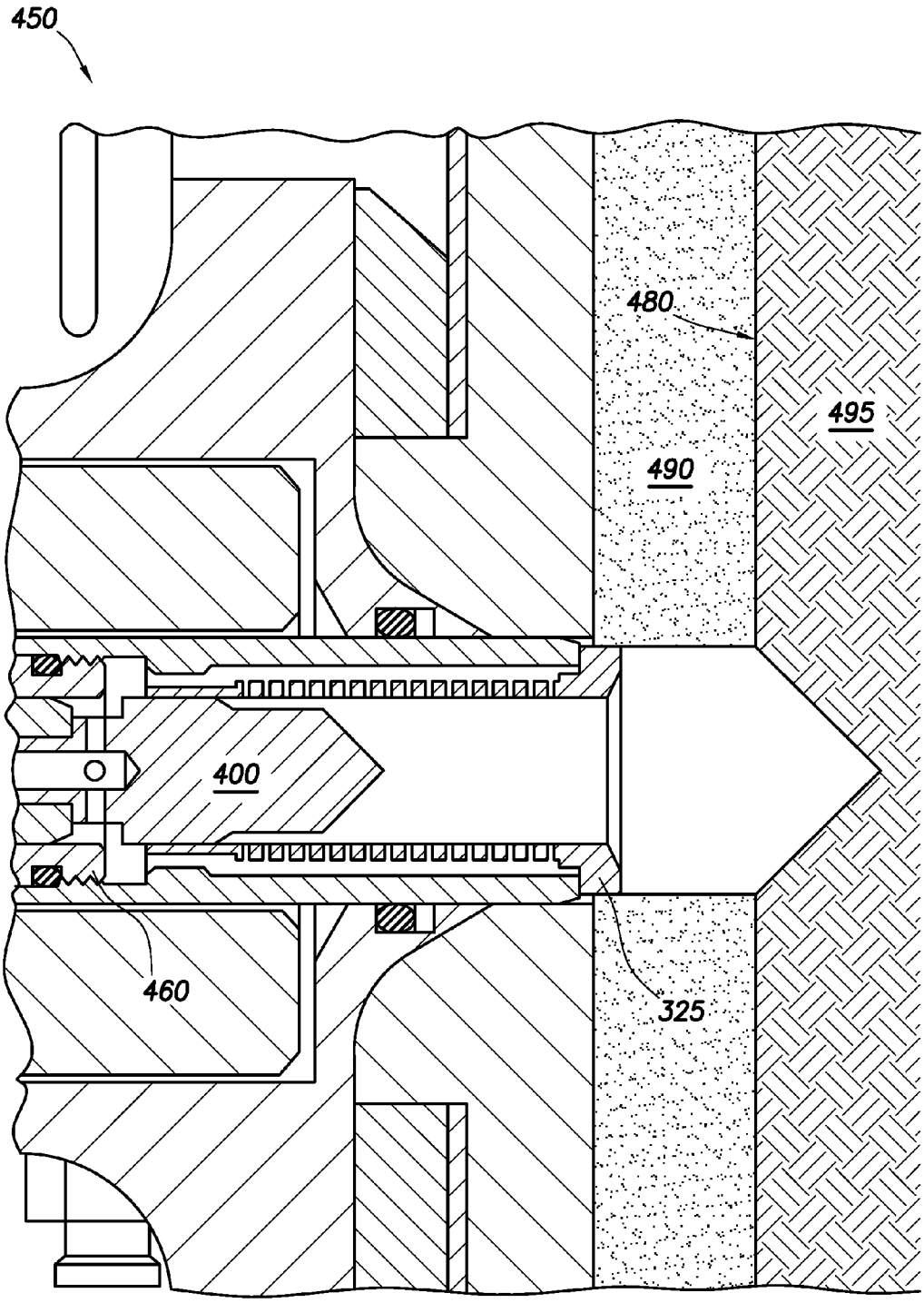

For example, FIG. 5 is a sectional view of the formation pressure tester 450 of FIG. 4 in which the filter piston 400 is shown in its extended position, and FIG. 6 is a sectional view of the formation pressure tester 450 in which the filter piston 400 is shown in its retracted position. Referring to FIGS. 5 and 6, collectively, the filter piston 400 is coupled to the actuator 460. Operation of the actuator 460 translates the filter piston 400 within the filter inlet 325 between the extended position (FIG. 5) and the retracted position (FIG. 6). When the probe assembly 450 is engaged with the wellbore wall 480, the filter inlet 325 may protrude slightly into the mudcake 490 lining the wellbore wall 480, and the filter piston 400 extends beyond the end of the filter inlet 325 to a point further embedded within the mudcake 490. As shown in FIG. 5, the filter piston 400 may extend through the mudcake 490 and at least partially through the wellbore wall 480 into the formation 495. Thereafter, as shown in FIG. 6, the filter piston 400 may be retracted to within the probe assembly 450, thus exposing the filter inlet 325 to the formation 495 through the opening 497 made in the mudcake 490.

Figure 7:
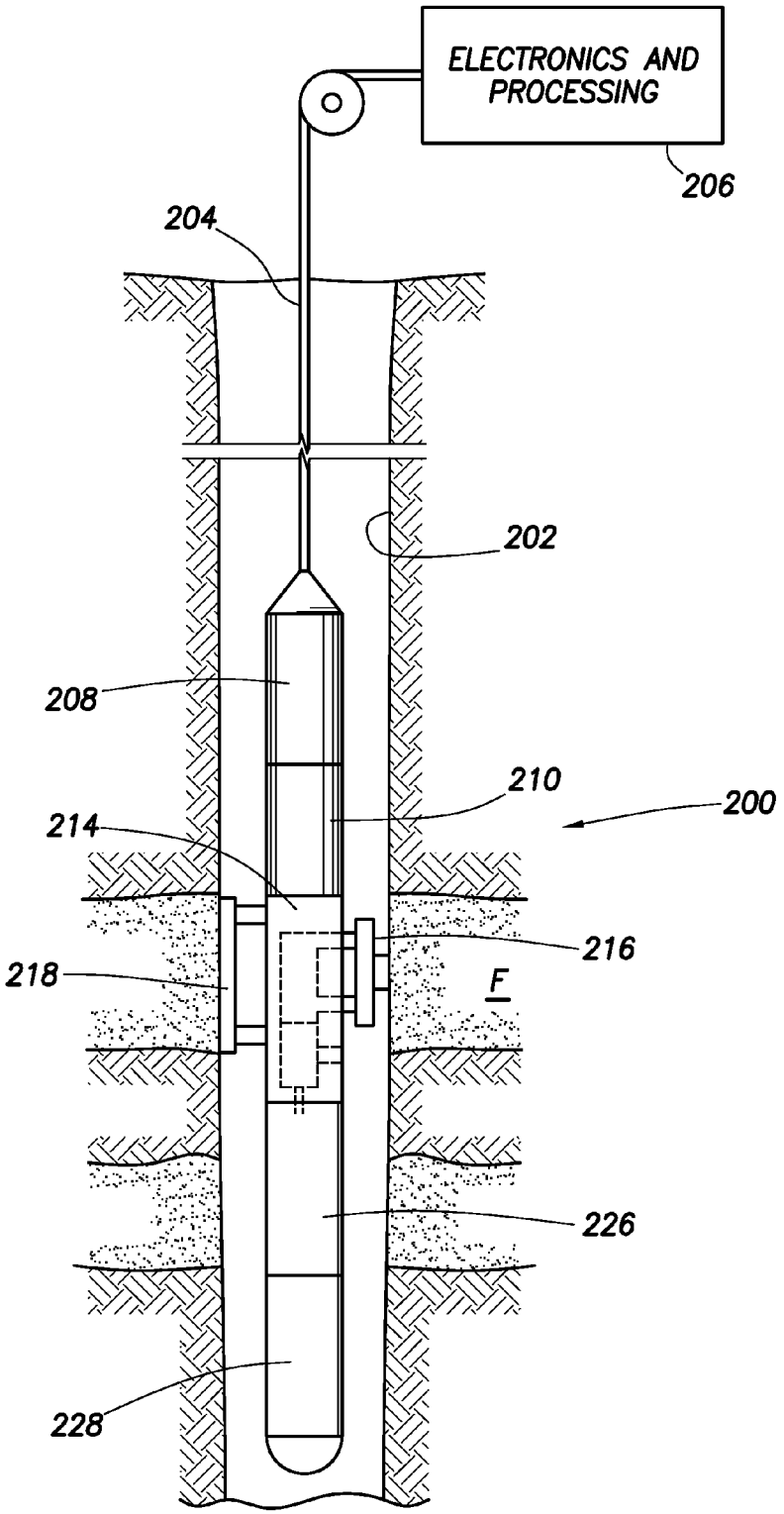
FIGS. 7 and 8 are schematic views of example embodiments of implementation of one or more aspects of the present disclosure.

Referring to FIG. 7, shown is an example wireline tool 200 that may be an environment in which aspects of the present disclosure may be implemented. The example wireline tool 200 is suspended in a wellbore 202 from the lower end of a multiconductor cable 204 that is spooled on a winch (not shown) at the Earth's surface. At the surface, the cable 204 is communicatively coupled to an electronics and processing system 206. The example wireline tool 200 includes an elongated body 208 that includes a formation tester 214 having a selectively extendable probe assembly 216 and a selectively extendable tool anchoring member 218 that are arranged on opposite sides of the elongated body 208. Additional components (e.g., 210) may also be included in the tool 200.

One or more aspects of the probe assembly 216 may be substantially similar to those described above in reference to the embodiments shown in FIGS. 1-6. For example, the extendable probe assembly 216 is configured to selectively seal off or isolate selected portions of the wall of the wellbore 202 to fluidly couple to the adjacent formation F and/or to draw fluid samples from the formation F. Accordingly, the extendable probe assembly 216 may be provided with a probe having an elongated filter piston, such as the filter piston 400 shown in FIGS. 3-6 and as otherwise described above. The formation fluid may be expelled through a port (not shown) or it may be sent to one or more fluid collecting chambers 226 and 228. In the illustrated example, the electronics and processing system 206 and/or a downhole control system are configured to control the extendable probe assembly 216 and/or the drawing of a fluid sample from the formation F.

Figure 8:
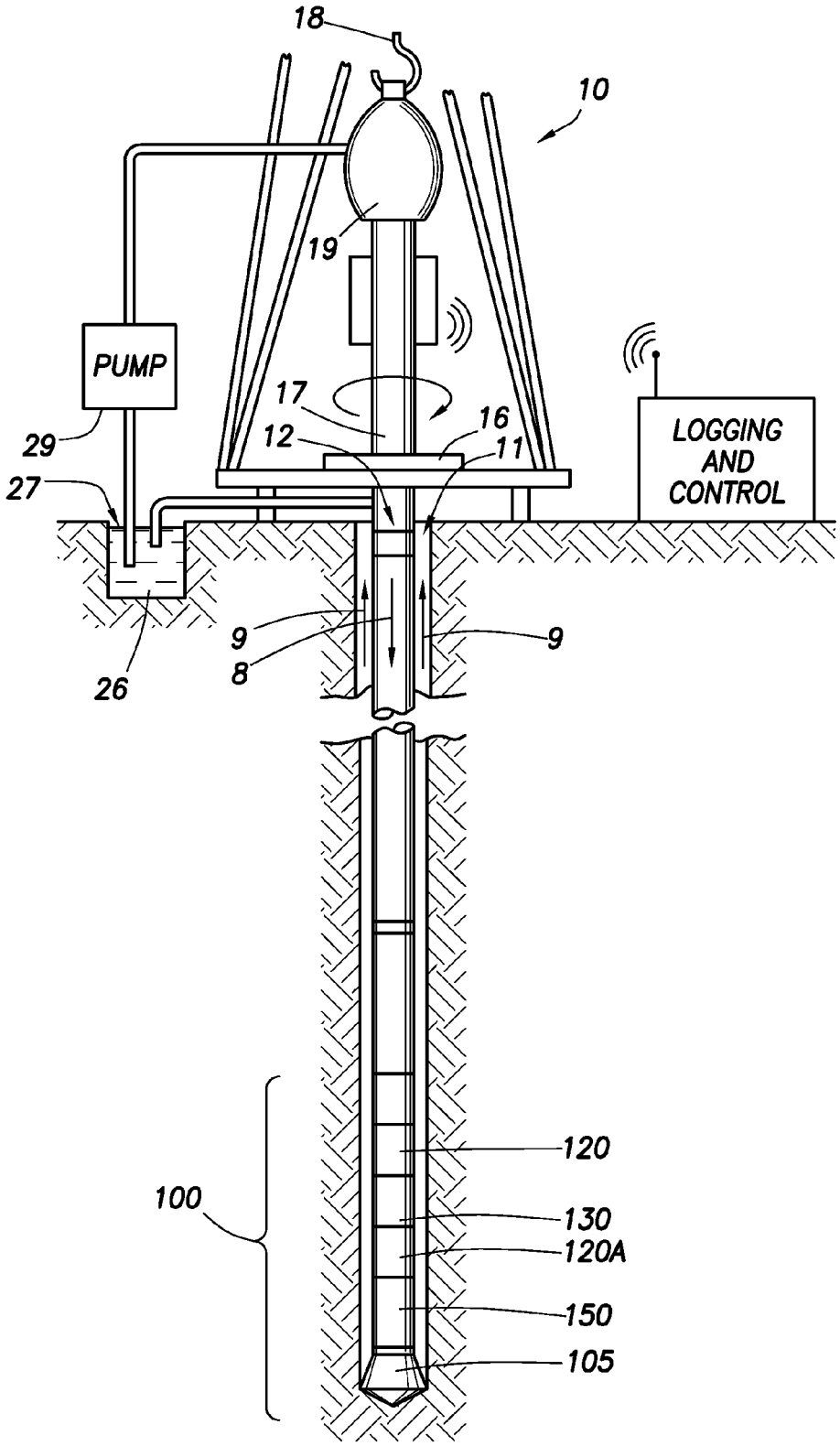

FIG. 8 illustrates another wellsite system in which aspects of the present disclosure may be employed. The wellsite can be onshore or offshore. In this exemplary system, a borehole 11 is formed in subsurface formations by rotary drilling in a manner that is well known. Embodiments of the invention can also use directional drilling.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the illustrated example, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment a logging-while-drilling (LWD) module 120, a measuring-while-drilling (MWD) module 130, a roto-steerable system and motor, and drill bit 105. The LWD module 120 is housed in a special type of drill collar, as is known in the art, and can contain one or a plurality of known types of logging tools. It will also be understood that more than one LWD and/or MWD module can be employed, e.g., as represented at 120A. (References, throughout, to a module at the position of 120 can alternatively mean a module at the position of 120A as well.) The LWD module includes capabilities for measuring, processing, and storing information, as well as for communicating with the surface equipment. For example, the LWD module may include a pressure measuring device that is substantially similar to or comprises the formation pressure tester tool 450 shown in FIG. 4.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. The MWD module may include one or more of the following types of measuring devices: a weight-on-bit measuring device, a torque measuring device, a vibration measuring device, a shock measuring device, a stick slip measuring device, a direction measuring device, and an inclination measuring device.

In view of all of the above and the figures, it should be readily apparent to those skilled in the pertinent art that the present disclosure introduces an apparatus comprising: a downhole tool configured for conveyance within a wellbore extending into a subterranean formation, the downhole tool comprising: a probe assembly comprising an inlet, a packer comprising an elastomeric material surrounding the inlet, and a filter piston actuatable between an extended position and a retracted position and having an external end, wherein: the inlet is open when the filter piston is in the retracted position; the external end substantially closes the inlet when the filter piston is in the extended position; and the filter piston protrudes from the inlet when the filter piston is in its extended position. The external end of the filter piston may have a tapered profile. The tapered profile may have a taper angle ranging between about 30° and about 120°. Alternatively, the tapered profile may have a taper angle ranging between about 70° and about 100°. In an exemplary embodiment, the tapered profile may have a taper angle of about 90°. The tapered profile may taper to a point, a rounded end, or a blunt end. The external end of the filter piston may comprise one or more flats configured for engagement with a tool utilized to assemble the filter piston to the probe assembly. The external end of the filter piston may be configured to expel filtered particulate from the inlet when translating from the retracted position to the extended position. The probe assembly may further comprise an actuator configured to translate the filter piston within the inlet between the extended position and the retracted position. The probe assembly may be configured to measure pressure of the formation surrounding the wellbore when the probe assembly is positioned in engagement with a wall of the wellbore. The probe assembly may be extendable from the downhole tool for sealing engagement with a mudcake or wall of the wellbore. The probe assembly may be extendable from the downhole tool via hydraulic, mechanical, electrical, or electromechanical actuation. The downhole tool may further comprise a controller and circuitry coupling pressure-representative signals from the probe assembly to the controller. The downhole tool may further comprise telemetry circuitry coupled to the controller. The downhole tool may be configured for conveyance within the wellbore via wireline or drill string.

The present disclosure also introduces a method comprising: positioning a downhole tool within a wellbore extending into a subterranean formation, wherein the downhole tool comprises: a probe assembly comprising an inlet, a packer comprising an elastomeric material surrounding the inlet, and a filter piston actuatable between an extended position and a retracted position and having an external end, wherein: the inlet is open when the filter piston is in the retracted position; the external end substantially closes the inlet when the filter piston is in the extended position; and the filter piston protrudes from the inlet when the filter piston is in its extended position; engaging the probe assembly with a wall of the wellbore, such that the inlet is positioned proximate a mudcake lining the wellbore wall; translating the filter piston from the retracted position towards the extended position, such that the external end of the filter piston extends beyond the inlet to a point embedded within the mudcake. Engaging the probe assembly with the wall of the wellbore may cause the inlet to protrude into the mudcake. Translating the filter piston may cause the external end of the filter piston to extend beyond the mudcake and into the formation. The method may further comprise retracting the filter piston to within the probe assembly, thus exposing the inlet to the formation through an opening created by translation of the filter piston. The opening may comprise a flowpath from the formation through the mudcake and to the probe assembly. The method may further comprise conveying the downhole tool within the wellbore via wireline or drill string.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus, comprising:

a downhole tool configured for conveyance within a wellbore extending into a subterranean formation, the downhole tool comprising:

a probe assembly comprising an inlet having one or more filter openings, a packer comprising an elastomeric material surrounding the inlet, and a filter piston actuatable between an extended position and a retracted position and having an external end, wherein:

in the extended position, the external end protrudes past the inlet to form an opening in the subterranean formation and substantially close the filter openings in the inlet; and in the retracted position, the filter piston is retracted within the inlet to expose the filter openings to the subterranean formation through the opening.

2. The apparatus of claim 1 wherein the external end of the filter piston has a tapered profile.

3. The apparatus of claim 2 wherein the tapered profile has a taper angle ranging between about 30° and about 120°.

4. The apparatus of claim 2 wherein the tapered profile has a taper angle ranging between about 70° and about 100°.

5. The apparatus of claim 2 wherein the tapered profile has a taper angle of about 90°.

6. The apparatus of claim 2 wherein the tapered profile tapers to a point.

7. The apparatus of claim 1 wherein the external end of the filter piston is configured to expel filtered particulate from the inlet when translating from the retracted position to the extended position.

8. The apparatus of claim 1 wherein the probe assembly further comprises an actuator configured to translate the filter piston within the inlet between the extended position and the retracted position.

9. The apparatus of claim 1 wherein the probe assembly is configured to measure pressure of the formation surrounding the wellbore when the probe assembly is positioned in engagement with a wall of the wellbore.

10. The apparatus of claim 1 wherein the probe assembly is extendable from the downhole tool for sealing engagement with a mudcake or wall of the wellbore.

11. The apparatus of claim 10 wherein the probe assembly is extendable from the downhole tool via hydraulic, mechanical, electrical, or electromechanical actuation.

12. The apparatus of claim 1 wherein the downhole tool further comprises a controller and circuitry coupling pressure-representative signals from the probe assembly to the controller.

13. The apparatus of claim 1 wherein the downhole tool is configured for conveyance within the wellbore via wireline or drill string.

14. The apparatus of claim 1 wherein the inlet comprises a cylindrical annulus extendable to engage the subterranean formation and wherein the filter piston is translatably disposed within the cylindrical annulus.

15. The apparatus of claim 1 wherein the filter piston is configured to extend within the inlet adjacent to the filter openings when the filter piston is in the extended position to block the filter openings, and to retract within the inlet past the filter openings to expose the filter openings to the subterranean formation when the filter piston is in the retracted position.

16. A method, comprising:

positioning a downhole tool within a wellbore extending into a subterranean formation, wherein the downhole tool comprises:

a probe assembly comprising an inlet having a one or more filter openings, a packer comprising an elastomeric material surrounding the inlet, and a filter piston actuatable between an extended position and a retracted position and having an external end;

engaging the probe assembly with a wall of the wellbore, such that the inlet is positioned proximate a mudcake lining the wellbore wall;

translating the filter piston to the extended position, such that the external end protrudes past the inlet to form an opening in the subterranean formation and substantially close the filter openings in the inlet; and translating the filter piston to the retracted position, such that the filter piston is retracted within the inlet to expose the filter openings to the subterranean formation through the opening.

17. The method of claim 16 wherein engaging the probe assembly with the wall of the wellbore causes the inlet to protrude into the mudcake.

18. The method of claim 16 wherein translating the filter piston causes the external end of the filter piston to extend beyond the mudcake and into the formation.

19. The method of claim 16 wherein the opening comprises a flowpath from the formation through the mudcake to the probe assembly.

20. The method of claim 16 further comprising conveying the downhole tool within the wellbore via wireline or drill string.

* * * * *